US009458858B2

(12) United States Patent
Jeong

(10) Patent No.: US 9,458,858 B2
(45) Date of Patent: Oct. 4, 2016

(54) MOUNTING STRUCTURE OF COOLING-FAN

(71) Applicant: Hyundai Motor Company, Seoul (KR)

(72) Inventor: Yu-Seorg Jeong, Hwaseong-si (KR)

(73) Assignee: Hyundai Motor Company, Seoul (KR)

( * ) Notice: Subject to any disclaimer, the term of this patent is extended or adjusted under 35 U.S.C. 154(b) by 483 days.

(21) Appl. No.: 14/107,577

(22) Filed: Dec. 16, 2013

(65) Prior Publication Data

US 2015/0104304 A1 Apr. 16, 2015

(30) Foreign Application Priority Data

Oct. 11, 2013 (KR) ..... 10-2013-0121385

(51) Int. Cl.

| | |
|---|---|
| ***F04D 29/64*** | (2006.01) |
| ***F04D 29/60*** | (2006.01) |
| ***F04D 25/12*** | (2006.01) |
| ***F04D 25/10*** | (2006.01) |
| ***F04D 29/56*** | (2006.01) |

(52) U.S. Cl.

CPC ..... *F04D 29/601* (2013.01); *F04D 25/105* (2013.01); *F04D 25/12* (2013.01); *F04D 29/563* (2013.01); *F04D 29/644* (2013.01); *F04D 29/646* (2013.01); *F05D 2260/50* (2013.01)

(58) Field of Classification Search

CPC .. F04D 19/002; F04D 29/644; F04D 29/464; F04D 25/10; F04D 25/105; F04D 25/12; F05D 2250/34; F05D 2260/50

See application file for complete search history.

(56) References Cited

U.S. PATENT DOCUMENTS

| | | | | | |
|---|---|---|---|---|---|
| 1,517,169 | A * | 11/1924 | Rogers | F04D 25/105 | 74/51 |
| 3,699,873 | A * | 10/1972 | Irvin | F24F 13/075 | 415/123 |
| 4,007,673 | A * | 2/1977 | Zaloga | F24F 13/15 | 415/125 |
| 7,568,888 | B2 * | 8/2009 | Castillo | F04D 29/362 | 416/143 |

FOREIGN PATENT DOCUMENTS

| | | | |
|---|---|---|---|
| JP | 2006-104943 | A | 4/2006 |
| JP | 2011-111129 | A | 6/2011 |

* cited by examiner

*Primary Examiner* — Ninh H Nguyen

(74) *Attorney, Agent, or Firm* — Morgan, Lewis & Bockius LLP

(57) ABSTRACT

A mounting structure of a cooling-fan mounted in an opening formed on a Front End Module (FEM) carrier may include a locking guide fixed to the opening and along a longitudinal direction of which a guide hole is formed, a link bar along a longitudinal direction of which a sliding hole is pierced and one end of which is connected rotatively to the FEM carrier, a first pin that is slid through the respective guide hole and sliding hole and connects the link bar and the locking guide, a second pin, one end of which is connected slidingly to the sliding hole, and a motor connected to the other end of the second pin to rotate the second pin. The cooling-fan is connected to the first pin and slid through the opening by link-movement of the first pin, the second pin and the link bar.

6 Claims, 3 Drawing Sheets

MOUNTING STRUCTURE OF COOLING-FAN

CROSS-REFERENCE TO RELATED APPLICATION

The present application claims priority of Korean Patent Application Number 10-2013-0121385 filed on Oct. 11, 2013, the entire contents of which application are incorporated herein for all purposes by this reference.

BACKGROUND OF INVENTION

1. Field of Invention

The present disclosure relates to a mounting structure of a cooling-fan, and more particularly, to a mounting structure of a cooling-fan, in which the cooling-fan is slid left/rightward (e.g., in a width direction of a vehicle) in an opening formed on FEM (Front End Module) carrier to improve further a cooling efficiency.

2. Description of Related Art

Generally, a FEM (Front End Module) carrier is a component that is assembled by integrating a bumper, a lamp, a hood latch and a cooling module, etc., which are mounted to a front of a vehicle. The FEM carrier is manufactured commonly in a rectangular shape in which an opening is formed, even though there is little difference depending on the kinds of a vehicle, and a cooling-fan 3 is mounted to the opening, as shown FIG. 1, so as to improve a cooling efficiency through external air introduced through the opening.

The cooling-fan 3 is fixed to the opening 2 of the FEM carrier 1 while a motor and a fan-blade 3*a* are connected to a shroud 3*b*. Here, two cooling-fans 3 may be arranged in the opening 2 in accordance with the kinds of a vehicle, but one cooling-fan is arranged commonly at a center of the opening.

However, a region to which external air is discharged (a region where the fan-blade is rotated) is a circular shape whereas the opening 2 is in a rectangular shape, and thus the cooling efficiency is decreased because of this configuration (one cooling-fan is only provided). That is, the cooling efficiency is excellent at an overlapping region of a rear of the fan-blade 3*a*, but the cooling efficiency is decreased at a region spaced from the fan-blade 3*a* (edge regions of the opening) since the passing wind amount is relatively smaller.

The above drawbacks can be solved by increasing the size of a radiator fin or mounting an additional cooling device (so as to increase heat exchange area), however, this causes to increase a manufacturing cost of a vehicle. Furthermore, when the power applied to the cooling-fan 3 is increased to increase the wind amount, it causes to increase the noise that is induced therefrom.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

Various aspects of the present invention have been made in an effort to solve at least some of the above-described problems associated with the prior art.

Various aspects of the present invention provide for a mounting structure of a cooling-fan, in which the cooling-fan is slid left/rightward not to form a region where the wind amount is not sufficient even though only one cooling-fan is provided, thereby improving further cooling performance.

Various aspects of the present invention provide for a mounting structure of a cooling-fan that is mounted in an opening formed on a FEM carrier according to the present invention may include: a locking guide which is fixed to the opening and along a longitudinal direction of which a guide hole is formed; a link bar along a longitudinal direction of which a sliding hole is pierced and one end of which is connected rotatively to the FEM carrier; a first pin that is slid through the respective guide hole and sliding hole and connects the link bar and the locking guide; a second pin, one end of which is connected slidingly to the sliding hole; and a motor which is connected to the other end of the second pin to rotate the second pin, wherein the cooling-fan is connected to the first pin and slid through the opening by the link-movement of the first pin, the second pin and the link bar in accordance with the rotation of the motor.

The opening may be formed in a rectangular shape with a width side longer than a vertical side and the locking guide is arranged within the opening such that the guide hole is oriented in a longitudinal direction of the opening and the link bar is connected to a portion the FEM carrier that forms the width side on a lower side of the opening in the FEM carrier. The motor may be disposed at a middle location below the locking guide and when the cooling-fan is disposed at a center portion of the opening, the link bar and the second pin are arranged to be substantially at a right angle to the locking guide. The cooling-fan may include a fan-blade that rotates to generate cooling wind and a shroud that embeds the fan-blade and protects it wherein the shroud is formed in a circular shape.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
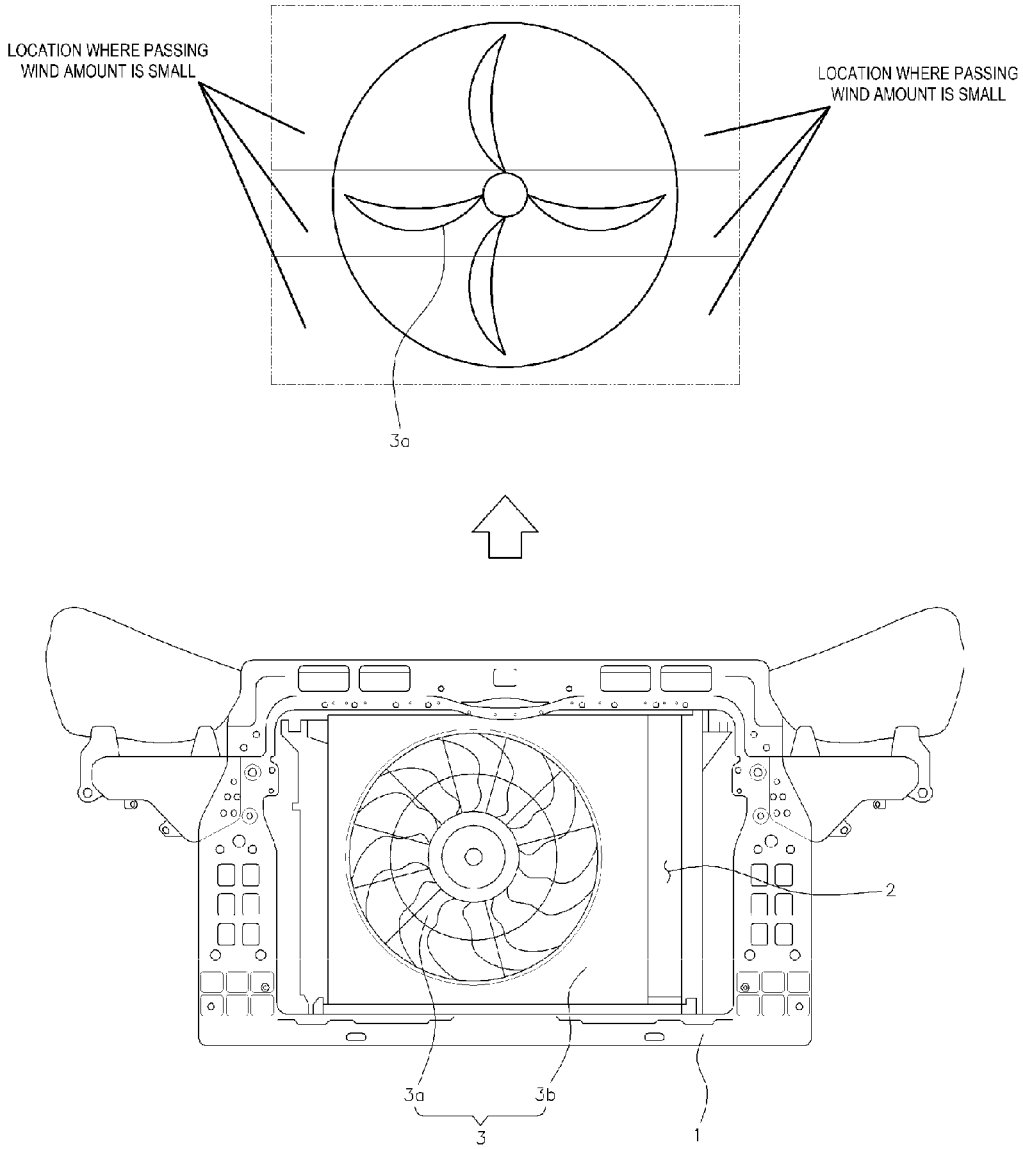
FIG. 1 is a perspective view showing a FEM carrier to which a conventional cooling-fan is mounted and a perspective view showing edge regions of the FEM carrier that is spaced from a cooling-fan toward both sides, at which the passing wind amount is formed to be small relatively.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 2:
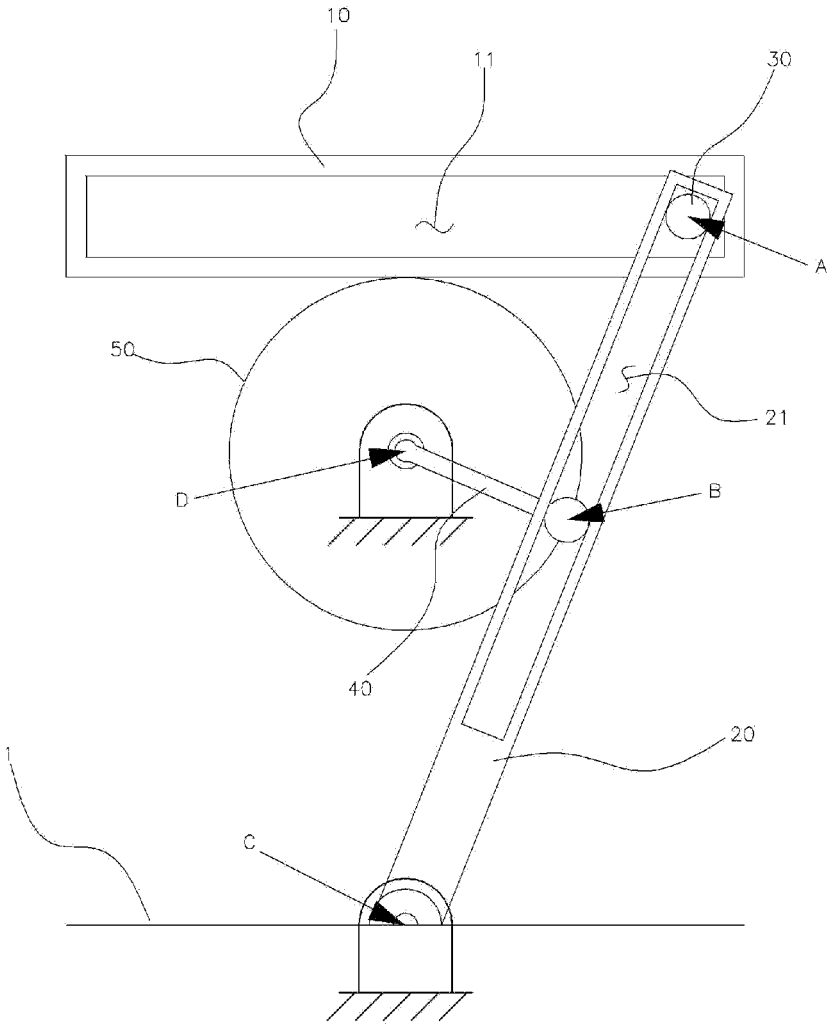
FIG. 2 is a perspective view showing an exemplary link structure for sliding the cooling-fan according to the present invention.
Figure 3:
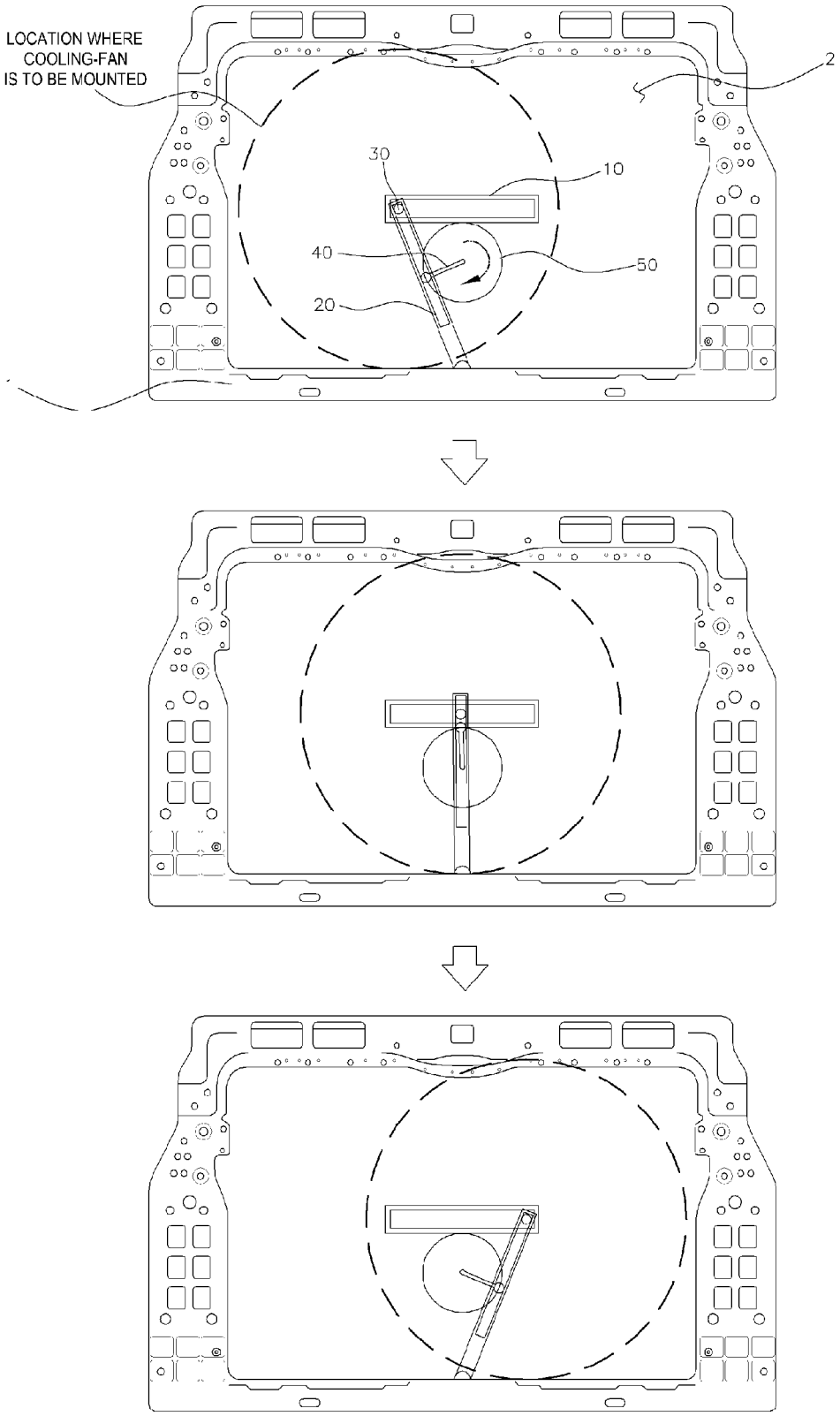
FIG. 3 is a view showing in sequence the sliding of the cooling-fan in the opening by the link-movement of a first pin, a second pin and a link bar in accordance with a rotation of a motor according to the present invention.

Referring to FIG. 2, a guide hole 11 is formed in a locking guide 10 in a longitudinal direction thereof and the locking guide 10 is mounted to a predetermined location within an opening 2 (see FIG. 3) of a FEM carrier 1 (in some cases, preferably a center or center portion of the opening) wherein both ends of the locking guide are directed left/rightward. The locking guide 10 is fixed to a radiator mounted to the FEM carrier 1 itself or the opening 2 through a bracket.

Further, a link bar 20 is connected to the locking guide 10 through a first pin 30. Here, the link bar 20 has a sliding hole 21 pierced in a longitudinal direction thereof and one end of the link bar 20 is connected rotatively to a point C of the FEM carrier 1 and the other end (point A) thereof is connected to the locking guide 10. The first pin 30 connects the link bar 20 and the locking guide 10 wherein it can be slid along the respective guide hole 11 and sliding hole 21.

A motor 50 is arranged below the locking guide 10 and one end (point D) of a second pin 40 is connected to the motor 50. The other end (point B) of the second pin 40 is connected to the sliding hole 21 to be slid.

In various embodiments of the present invention, the opening 2 is formed in a rectangular shape wherein a width side is longer than a vertical side and the locking guide 10 is arranged within the opening 2 such that the guide hole 11 is laid or oriented in a longitudinal direction and the link bar 20 is connected to a portion that forms a width side on a lower side of the opening in the FEM carrier 1.

Furthermore, the motor 50 is disposed at a middle location below the locking guide 10 and when the cooling-fan (that is, the first pin) is disposed at a center or center portion of the opening 2, the link bar 20 and the second pin 40 are arranged to be at or substantially at a right angle to the locking guide 10.

According to the mounting structure of a cooling-fan as described above, the second pin 40, the link bar 20 and the first pin 30 are link-moved coorperatively in accordance with an operation of the motor 50. That is, the rotational movement of the motor 50 is converted into a left/right reciprocal movement of the first pin 30 at the guide hole 11 and thus the cooling-fan can be slid left/rightward in the opening 2 by connecting the cooling-fan to the first pin 30 (in more detail, the cooling-fan is connected for the fan-blade to be rotated at the point A).

Meanwhile, the cooling-fan according to the present invention, like the conventional cooling-fan, includes a fan-blade that rotates to generate cooling wind and a shroud that embeds the fan-blade and protects it wherein the shroud is formed in a circular shape to be rolled in the opening 2. That is, the shroud is formed in a rectangular shape (as shown in FIG. 1), and in this case a separate sliding device has to be provided for helping the sliding of the shroud and the output of the motor 50 has to be increased for the sliding of the shroud. Accordingly, the shroud may be formed in a circular shape to be rolled in accordance with the movement of the first pin 30 so as to simplify the shroud or not to need the separate sliding device and the increasing of output of the motor.

According to the mounting structure of a cooling-fan as described above, as shown in FIG. 3, when the motor 50 rotates in a clockwise (or counter-clockwise), the link bar 20 is pendulum-moved, like the movement of a pendulum bar mounted on a metronome, in accordance with the rotation of the second pin 40 and at the same time the first pin 30 is slid left/rightward. Accordingly, the cooling-fan connected to the first pin 30 is to be slid to both sides of the opening.

According to the present invention, the cooling-fan is slid in the opening 2 to improve further the cooling efficiency and further capacities of a radiator and accessory components can be reduced thereby to reduce the weight of a vehicle and save manufacturing cost thereof. Further, the cooling-fan can be moved to a specific location required to be cooled depending on a driving circumference (for example, a location where an oil cooler or a condenser is connected to the radiator) and thus the cooling performance thereof cannot be decreased and fan noise can be inhibited even though the output of the cooling-fan is reduced.

According to the mounting structure of a cooling-fan of the present invention, the cooling-fan is slid in the opening and thus the cooling performance can be improved using only one cooling-fan. Furthermore, the capacities of the radiator and the accessory components can be reduced in accordance with the improvement of the cooling-fan thereby to reduce the weight of a vehicle and save the manufacturing cost.

Meanwhile, the cooling-fan can be moved to a location where the cooling is required in accordance with a driving circumference and thus the cooling performance thereof cannot be decreased and fan noise can be inhibited even though the output of the cooling-fan is reduced. Additionally, the shroud of the cooling-fan is formed in a circular shape and thus is to be rolled in accordance with the left/right sliding of the fan-blade thereby to decrease the required output of a motor.

For convenience in explanation and accurate definition in the appended claims, the terms "upper" or "lower", "left" or "right", and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A mounting structure of a cooling-fan that is mounted in an opening formed on a Front End Module (FEM) carrier, the mounting structure comprising:

a locking guide which is fixed to the opening and along a longitudinal direction of which a guide hole is formed;

a link bar along a longitudinal direction of which a sliding hole is pierced and one end of which is connected rotatively to the FEM carrier;

a first pin that is slid through the respective guide hole and sliding hole and connects the link bar and the locking guide;

a second pin, one end of which is connected slidingly to the sliding hole; and a motor which is connected to the other end of the second pin to rotate the second pin, wherein the cooling-fan is connected to the first pin and slid through the opening by link-movement of the first pin, the second pin and the link bar in accordance with rotation of the motor.

2. The mounting structure of a cooling-fan of claim 1, wherein the opening is formed in a rectangular shape with a width side longer than a vertical side and the locking guide is arranged within the opening such that the guide hole is oriented in a longitudinal direction of the opening and the link bar is connected to a portion of the FEM carrier that forms the width side on a lower side of the opening in the FEM carrier.

3. The mounting structure of a cooling-fan of claim 2, wherein the motor is disposed, at a middle location below the locking guide and when the cooling-fan is disposed at a center portion of the opening, the link bar and the second pin are arranged to be substantially at a right angle to the locking guide.

4. The mounting structure of a cooling-fan of claim 3, wherein the cooling-fan comprises a fan-blade that rotates to generate cooling wind and a shroud that embeds the fan-blade and protects it wherein the shroud is formed in a circular shape.

5. The mounting structure of a cooling-fan of claim 2, wherein the cooling-fan comprises a fan-blade that rotates to generate cooling wind and a shroud that embeds the fan-blade and protects it wherein the shroud is formed in a circular shape.

6. The mounting structure of a cooling-fan of claim 1, wherein the cooling-fan comprises a fan-blade that rotates to generate cooling wind and a shroud that embeds the fan-blade and protects it wherein the shroud is formed in a circular shape.

* * * * *